US012241370B1

(12) United States Patent
Buerger et al.

(10) Patent No.: US 12,241,370 B1
(45) Date of Patent: Mar. 4, 2025

(54) SYSTEMS AND METHODS FOR AUTOMATED DRILLING OF HIGH ASPECT RATIO, SMALL DIAMETER HOLES IN REMOTE, CONFINED SPACES

(71) Applicant: National Technology & Engineering Solutions of Sandia, LLC, Albuquerque, NM (US)

(72) Inventors: Stephen Buerger, Albuquerque, NM (US); Michal Rittikaidachar, Albuquerque, NM (US); Clinton G. Hobart, Albuquerque, NM (US); Jonathon Slightam, Albuquerque, NM (US); Jiann-Cherng Su, Albuquerque, NM (US); Giorgia Bettin, Rio Rancho, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 119 days.

(21) Appl. No.: 17/743,133

(22) Filed: May 12, 2022

Related U.S. Application Data

(60) Provisional application No. 63/188,061, filed on May 13, 2021.

(51) Int. Cl.
*E21B 7/04* (2006.01)
*E21B 4/04* (2006.01)
(Continued)

(52) U.S. Cl.
CPC ..... *E21B 7/046* (2013.01); *E21B 4/04* (2013.01); *E21B 47/00* (2013.01); *E21B 47/005* (2020.05)

(58) Field of Classification Search
CPC . E21B 7/046; E21B 4/04; E21B 47/00; E21B 47/005
See application file for complete search history.

(56) References Cited

U.S. PATENT DOCUMENTS 2,250,671 A * 7/1941 Joy ..... E21B 7/005 175/404
4,155,409 A * 5/1979 Crawshay ..... E21B 19/00 173/29

(Continued)

*Primary Examiner* — Nicole Coy
*Assistant Examiner* — Nicholas D Wlodarski
(74) *Attorney, Agent, or Firm* — Daniel J. Jenkins; Kenneth P. McNeill

(57) ABSTRACT

A compact drill assembly, a drilling system and a method for automatically drilling small diameter holes of arbitrary depth. The compact drill assembly includes a housing having a geometry that allows insertion into the confined space and a rotatable drilling spindle that includes an actuated locking collet assembly arranged and disposed to selectively secure and release a composite bit. A bit conveying arrangement is configured to convey the composite bit along the non-confined dimension and along the confined dimension through the actuated locking collet assembly. A drill drive is arranged and disposed to advance the rotatable drilling spindle along the confined dimension. The method includes conveying a composite bit along the non-confined dimension and along the confined dimension through the compact drill assembly and advancing the composite bit along the confined dimension to drill into a surface along an edge of the confined space.

17 Claims, 10 Drawing Sheets

(51) Int. Cl.
*E21B 47/00* (2012.01)
*E21B 47/005* (2012.01)

(56) References Cited

U.S. PATENT DOCUMENTS

| | | | | | |
|---|---|---|---|---|---|
| 5,133,418 | A * | 7/1992 | Gibson | E21B 47/022 | 175/45 |
| 5,425,429 | A * | 6/1995 | Thompson | E21B 49/06 | 175/77 |
| 5,746,279 | A * | 5/1998 | Havlinek | E21B 19/18 | 175/52 |
| 8,196,677 | B2 * | 6/2012 | Montgomery | E21B 4/14 | 175/73 |
| 8,471,560 | B2 * | 6/2013 | Freedman | G01V 3/18 | 324/303 |
| 9,347,267 | B2 * | 5/2016 | Koch | E21B 7/046 | |
| 9,863,206 | B2 * | 1/2018 | Biester | E21B 34/16 | |
| 10,946,455 | B2 * | 3/2021 | Sigafoose | B23B 31/20125 | |
| 2005/0217848 | A1 * | 10/2005 | Edwards | E21B 49/10 | 166/66 |

* cited by examiner

SYSTEMS AND METHODS FOR AUTOMATED DRILLING OF HIGH ASPECT RATIO, SMALL DIAMETER HOLES IN REMOTE, CONFINED SPACES

CROSS REFERENCE TO RELATED APPLICATIONS

This application claims priority to, and the benefit of, U.S. Provisional Patent Application Ser. No. 63/188,061, filed May 13, 2021, entitled "SYSTEMS AND METHODS FOR AUTOMATED DRILLING OF HIGH ASPECT RATIO, SMALL DIAMETER HOLES IN REMOTE, CONFINED SPACES," the content of which is incorporated in its entirety.

GOVERNMENT INTEREST STATEMENT

This invention was made with Government support under Contract No. DE-NA0003525 awarded by the United States Department of Energy/National Nuclear Security Administration. The U.S. Government has certain rights in this invention.

FIELD OF THE INVENTION

The present invention is directed to systems and methods for drilling high aspect ratio, small diameter holes in a confined space

BACKGROUND OF THE INVENTION

The integrity of oil and gas wells is a large environmental and energy security problem, with an estimated 30% of the 4 million wells worldwide showing signs of integrity failure. Current industry paradigms for well design include using cement as a barrier with envisioned lifetimes of about 50 years; however, the number of cementing problems which can go undetected can be staggering and the evaluation, characterization and remediation of wells has become a priority for industry, regulators, and the public. A primary challenge of wellbore integrity assessment is that operators rely on a combination of indirect measurements (through casing) and models to assess these very complex systems (wellbore and flaws). Measurements must be taken in confined spaces at distances up to several miles from human operators. Results are often subjective with large uncertainties.

Drilling high quality, small diameter, high aspect-ratio holes, such as the holes required to implant sensors, is a persistent challenge in machining, regardless of process technology. For mechanical drilling, central challenges include susceptibility to buckling, clearing cuttings, and torsional compliance and strength. For hole diameters on the order of 0.1 inches or less, length-to-diameter ratios of 20:1 to 30:1 are heralded as significant successes and little progress has been made in the last decade to improve this. At smaller diameters, on the micron scale, researchers report aspect ratios on the order of 4:1. Interestingly, dramatically different techniques such as laser drilling and electro discharge machining (EDM) appear to be limited to similar aspect ratios in the same size range. Exotic multi-stage laser drilling processes may produce aspect ratios of 30:1 to 60:1, and EDM results with aspect ratios around 30:1 have also been considered successful. Adapting existing systems and methods presents several challenges including bit buckling, limited torsional stiffness, chip clearing, and limited space for the bit and mechanism.

In rock drilling applications, depths thousands of times greater than hole diameters are routinely achieved. Several aspects of the rock drilling approach enable this capability, including, but not limited to keeping the drill string in tension, actively clearing cuttings with pressurized fluid, and assembling the drill string as the hole is drilled (e.g., by connecting segments of drill pipe). However, rock drilling operations do not permit small diameter, high aspect-ratio holes in confined spaces, particularly small holes orthogonal to drilled wellbores.

In addition to the fundamental challenge of drilling deep, small diameter holes, wellbore integrity monitoring also has the need to operate a drilling mechanism in a very small, remote space. With desired hole depths, orthogonal to the wellbore, exceeding the orthogonal clearance in the tool space, which is the wellbore diameter, by as much as 50-100%, there is not even sufficient room to capture a rigid drill bit of sufficient length—let alone a large drilling mechanism.

What is needed are methods and systems that are capable of drilling small diameter holes in confined spaces that overcome the limitations of the prior art.

SUMMARY OF THE INVENTION

The present disclosure is directed to systems and methods for drilling small diameter holes of arbitrary depth in confined spaces. The systems and methods enable monitoring the integrity of oil and gas wells in situ by the precise drilling of very small diameter, high aspect ratio holes, particularly in dimensionally constrained spaces. Adapting existing systems and methods presents several challenges including bit buckling, limited torsional stiffness, chip clearing, and limited space for the bit and mechanism. The presently disclosed systems and methods overcome these and more challenges.

According to an embodiment of the disclosure, a compact drill assembly for automatically drilling small diameter holes of arbitrary depth is disclosed. The compact drill assembly includes a housing having a geometry that allows insertion into the confined space and a rotatable drilling spindle that includes an actuated locking collet assembly arranged and disposed to selectively secure and release a composite bit. A bit conveying arrangement is configured to convey the composite bit along the non-confined dimension and along the confined dimension through the actuated locking collet assembly. A drill drive is arranged and disposed to advance the rotatable drilling spindle along the confined dimension.

According to an embodiment of the disclosure, a drilling system for drilling high aspect ratio, small diameter holes in a confined space having a confined dimension and a non-confined dimension is disclosed. The system includes a housing having a geometry that allows insertion into the confined space and a rotatable drilling spindle that includes an actuated locking collet assembly arranged and disposed to selectively secure and release a composite bit. A bit conveying arrangement is configured to convey the composite bit along the non-confined dimension and along the confined dimension through the actuated locking collet assembly. A drill drive is arranged and disposed to advance the rotatable drilling spindle along the confined dimension.

According to an embodiment of the disclosure, a method for drilling in a confined space having a confined dimension and a non-confined dimension is disclosed. The method includes directing a compact drill assembly into the confined space along the non-confined dimension. The compact drill assembly is secured within the confined space. A composite bit is conveyed along the non-confined dimension and along the confined dimension through the compact drill assembly. The composite bit is advanced along the confined dimension and is rotated with the compact drill assembly to drill into a surface along an edge of the confined space.

Various embodiments disclose the design of small diameter, high aspect ratio, precise drilling systems and methods. The systems minimize the unsupported composite bit length throughout the process, enabling the bit to be progressively fed from compact drill assembly as depth increases. In an embodiment, holes of arbitrary depth and aspect ratio may be drilled orthogonal to a wellbore. Holes drilled with the compact drill assembly include substantially greater aspect ratios than conventional methods with very long drill bits. In one embodiment, the compact drill assembly forms holes with an L/D ratio of at least 75:1 or at least 100:1. In another, the compact drill assembly forms 1/16 inch or less diameter holes at a depth of 9 inches or greater at a L/D ratio of at least 144:1.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

This disclosure provides for a compact mechatronic system that enables drilling of very high aspect ratio, small-diameter holes in remote, confined spaces. The system according to the present disclosure addresses some of the challenges associated with drilling such holes by a) limiting the unsupported drill bit length throughout the drilling process, b) actively injecting energy to remove cuttings, and c) enabling the use of flexible drills to extend drillable length. The systems and methods according to the present disclosure automate drilling capability and the ways that the controlled process interacts with drilling mechanics.

In one embodiment, the present disclosure provides a new approach to structural/material integrity that uses small holes to be precisely drilled into a structure/material. In an embodiment, the small holes may be drilled into and potentially through a body to the structure/material to be monitored. In various embodiments, the access to the point of drilling may be distant and/or remote with the space confined and/or restricted in diameter or area. In an embodiment, the confined space may be a steel well casing. In an embodiment, the structural/material integrity may be that of an outer cement well casing. In various embodiments, the small holes may be used to place various sensors to monitor the area surrounding the sensors. The holes may be drilled at an angle from the direction of access to the drilling point, such as orthogonal to the access direction. In one embodiment, the holes may be filled after drilling of the holes. For example, the holes may be filled with sensors, equipment or filler material.

Figure 1:
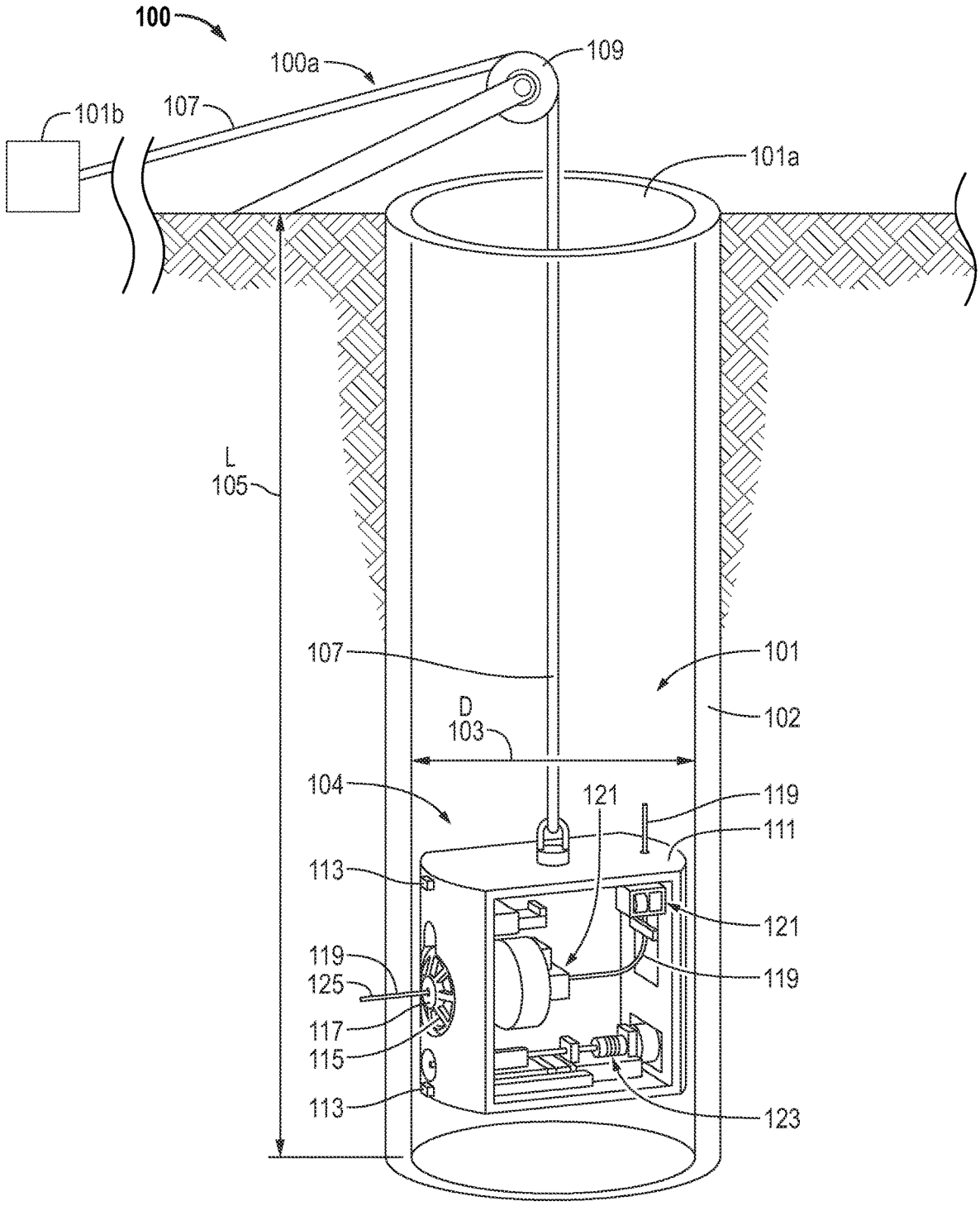
FIG. 1 shows a drilling system according to an embodiment of the present disclosure.

FIG. 1 shows a drilling system 100 for drilling high aspect ratio, small diameter holes in a confined space 101 according to an embodiment of the disclosure. The confined space 101 has a confined dimension 103 and a non-confined dimension 105 having at least one opening 101*a* not in the axis of the confined dimension. The confined dimension 103 is a dimension that has no access to outside that confined space from that dimension. In an embodiment, the confined dimension 103 may have restricted access that prevents a drilling tool from having access to the confined space. In the exemplary embodiment shown in FIG. 1, the confined space 101 is the interior space of a wellbore 102 having a generally cylindrical geometry having a length (L) 105 to diameter (D) 103 ratio (L/D). In this exemplary embodiment, the confined space has an L/D greater than 1000:1 In other embodiments, the L/D may be between 5:1 to 50000:1. In an embodiment, the L/D may be between 1000:1 and 10000:1. In various embodiments, the diameter D may be between 5 inches and 48 inches.

As discussed above, in the wellbore 102, the confined dimension 103 is the diameter of the wellbore 102. In this exemplary embodiment, the wellbore 102 has no opening opposing opening 101*a* and the non-confined dimension 105 is the depth of the wellbore 102. In other embodiments, the confined space 101 is not limited to a cylindrical wellbore 102 and may include other spaces, such as, but not limited to pipes, pipelines, conduits, ducts, conveyances, and other structures that have limited or restricted access. In those other embodiments, the confined spaces are not limited to cylindrical geometries, but include cylindrical, rectangular prismatic, elliptical prismatic, irregular and other geometries. For example, the confined space 101 may be an access space created to enable repairs/maintenance to foundations or other underground structures, a storage tank (e.g., underground waste tank or above-ground tank for hazardous materials), a storage container for chemical, nuclear or radiological waste, a tunnel, or a utility chase.

The drilling system 100 includes an insertion assembly 100*a* and a compact drill assembly 104 positioned in confined space 101. In one embodiment, the compact drill assembly 104 is directed into the confined space 101 along the non-confined dimension 105. In this exemplary embodiment, the insertion assembly 101*a* is a cable or line 107, a control rig 109 and a winch (101*b*). In other embodiments, the insertion assembly 101*a* may be a wireline with gravity feed, a crawling or climbing device, a fluid buoyancy mechanism, a drillstring lowered into a cased hole, or a robot that may be wheeled, tracked, legged or otherwise mobile that is capable of inserting the compact drill assembly into a confined space.

In the embodiment shown in FIG. 1, the compact drill assembly 104 is lowered into the confined space 101, which is a wellbore 102, along the non-confined dimension 105. Motion along the non-confined dimension 105 is a motion in a direction corresponding to an axis downward into the wellbore 102. The motion and support for the compact drill assembly 104 are provided by line 107 which is suspended from control rig 109. The control rig 109 permits support and motion of compact drill assembly 104. Line 107 may be any support structure, including but not limited to a cable, rope, chain, or other suitable flexible support structure capable of supporting the compact drill assembly 104. In some embodiments, wiring and/or electronics may be provided as line 107 or in addition to line 107, such as cabling run parallel to line 107, to provide control and/or signal to the drill assembly. In other embodiments, compact drill assembly 104 may also be powered by batteries or other portable power sources. Signal, for example for control of the assembly, may be provided by line 107 or wirelessly via any suitable wireless transmission method, such as, but limited to, wireless fidelity (Wi-Fi), Wi-Fi direct, wireless USB (wireless universal serial bus), BLUETOOTH (BLUETOOTH), Radio Frequency Identification (RFID), infrared data association (IrDA), Ultra-Wideband (UWB), Near Field Communication (NFC), point-to-point optical/laser communications, and acoustic communications.

The compact drill assembly 104 includes a housing 111 having a geometry that allows insertion into the confined space 101. The geometry of housing 111 may include any suitable dimensions that permit the positioning of the compact drill assembly 104 into the confined space 101. The housing 111 has a dimension less than the confined dimension of the confined space 101 so the housing 111 may be inserted into the confined space. The housing 111 may be cylindrical, cuboid, spherical or other geometry that permits positioning into the confined space 101. The housing 111 includes structures to support and position the drilling equipment. In addition, housing 111 includes securing features 113 that are capable of engaging surfaces of the confined space 101 and securing the compact drill assembly 104 into a position within the confined space 101. Securing features 113 also include an actuator (not shown) that extend or retract the securing features in a direction away from housing 111 to secure or release the compact drill assembly 104 in a location within the confined space 101. The securing features 113 may be protrusions, pads, hooks, friction features or other structures that are capable of securing the compact drill assembly 104 within the confined space 103. In other embodiments, the securing features 113 may include wheels or other drive mechanisms that allow movement and positioning of the compact drill assembly 104. In this embodiment, the wheels or drive mechanisms may secure the compact drill assembly 104 or securing features 113 may also be used to secure the compact drill assembly 104.

Figure 2:
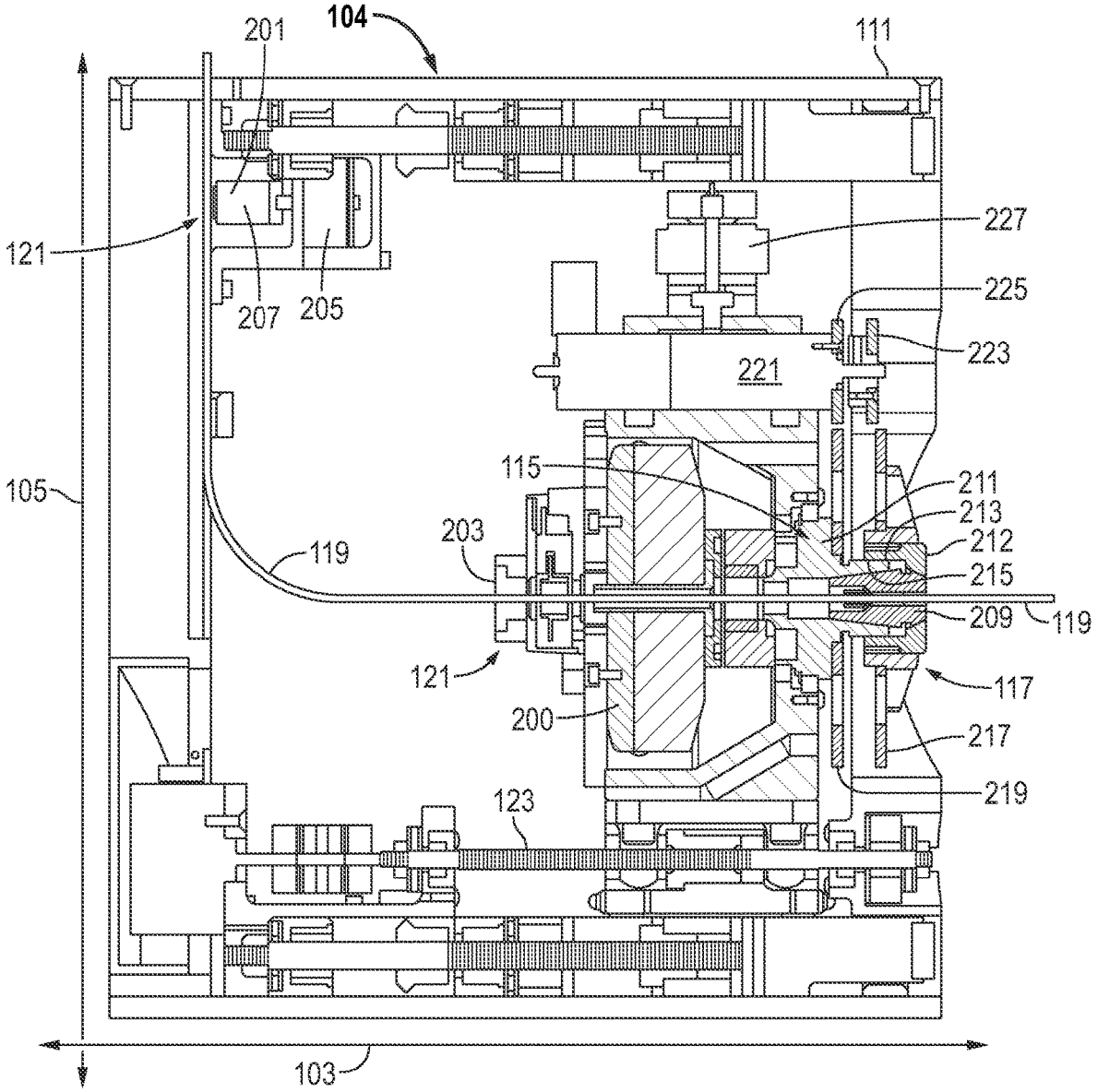
FIG. 2 shows a cutaway view of a compact drill assembly according to an embodiment of the present disclosure.
Figure 6:
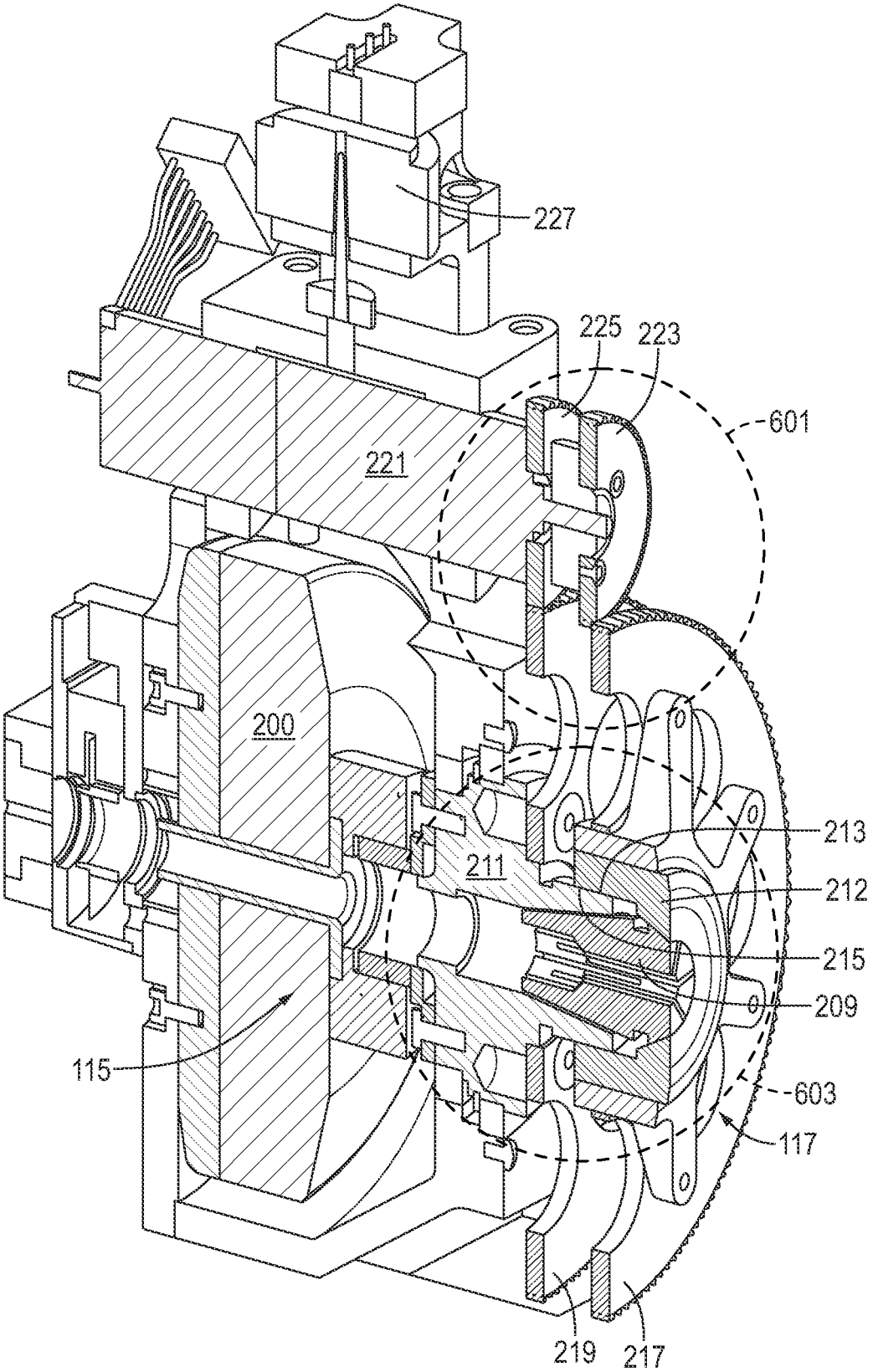
FIG. 6 shows a cutaway view of the portion of the compact drill assembly of FIG. 3 shown in direction 6-6.
Figure 7:
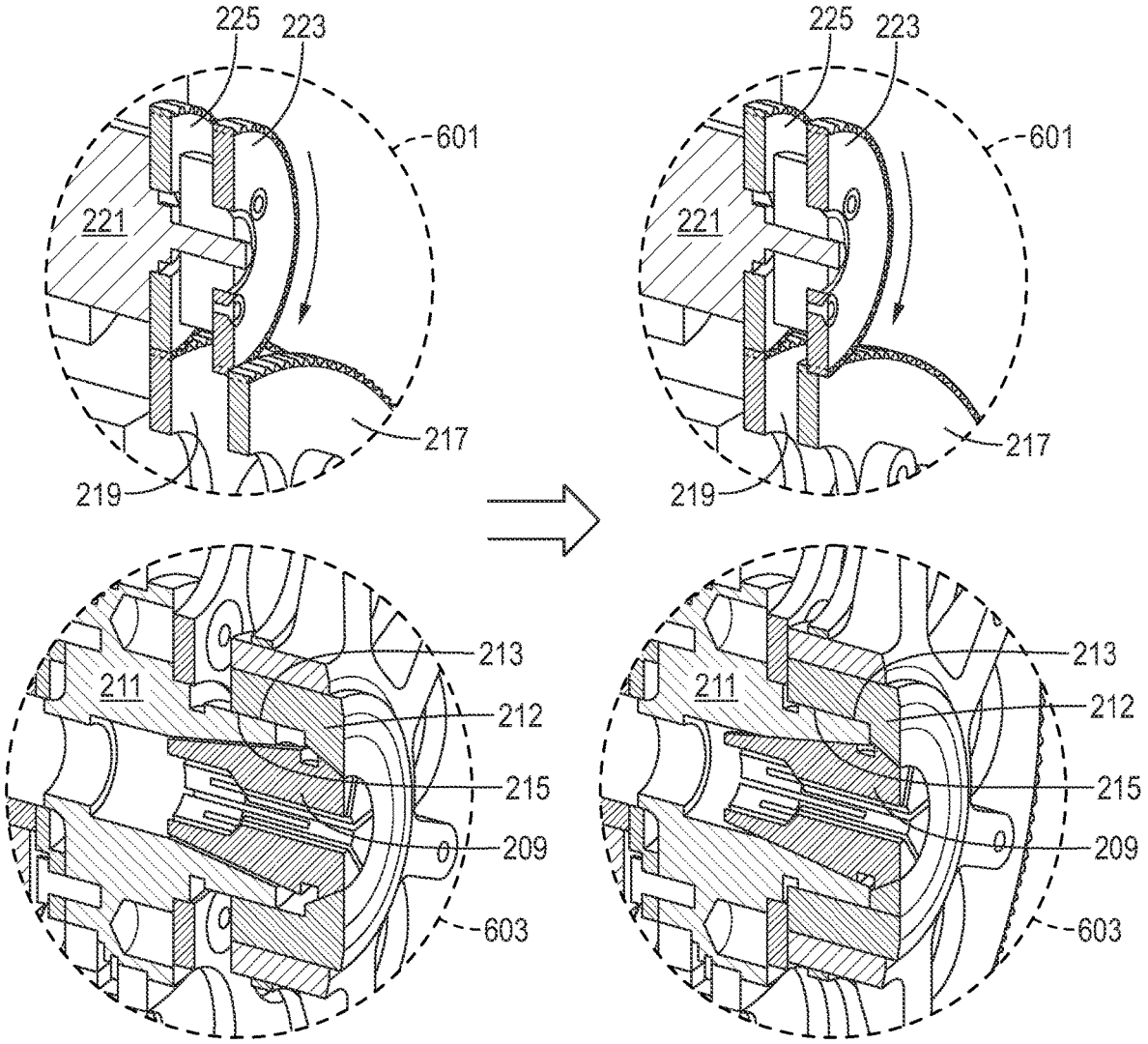
FIG. 7 shows an enlarged portion of actuated locking collet assembly of FIG. 6 moving from a released position to an engaged position.

As shown in FIGS. 2 and 6-7, drill assembly 104 includes a rotatable drilling spindle 115 that includes an actuated locking collet assembly 117 arranged and disposed to selectively secure and release a composite bit 119. The drilling spindle 115 also includes a drilling motor 200 that is a motor or other drive mechanism arranged to provide rotation to the drilling spindle 115, including the actuated locking collet assembly 117 and the composite bit 119. Rotation of the drilling spindle 115 by drilling motor 200 is sufficient to facilitate drilling by the composite bit 119. Drilling rotation provided by drilling motor 200 includes rotation of the composite bit 119 at from up to 20,000 RPM or up to 10,000 RPM or up to 5,250 RPM or up to 5,000 RPM. Particularly suitable drilling speeds are up to 5,000 RPM. The actuated locking collet assembly 117 includes a mechanical arrangement that is capable of exerting a clamping force to secure the composite bit 119. The actuated locking collet assembly 117 according to the present disclosure is actuatable to either secure or release the composite bit 119. In the released position, the composite bit 119 is movable and may be advanced or retracted withing the drilling spindle 115. Actuation of the actuated locking collet assembly 117 can be a mechanical actuation or electronic actuation. Composite bit 119 is retained when the actuated locking collet assembly 117 is in a secured position within the rotatable drilling spindle 115. When the composite bit 119 is retained, the composite bit 119 may be rotated with the rotatable drilling spindle 115 to facilitate drilling. The composite bit 119 utilized in the drilling system 100 may be a bit having a rigid section 801 and a flexible section 803 (see for example, FIG. 8). In other embodiments, the composite bit 119 may be a composite bit formed of multiple materials or may be a flexible, single-material bit.

The compact drill assembly 104 further includes a bit conveying arrangement 121 that is configured to convey the composite bit 119 along the non-confined dimension 105 and along the confined dimension 103 through the actuated locking collet assembly 117. As shown in FIGS. 1 and 2, the composite bit 119 is aligned in a vertical direction along the axis of the wellbore 102 and is directed in a direction perpendicular to the wellbore axis to an axis that permits drilling into the sidewall of the wellbore 102. As show in FIGS. 2-5, the bit conveying arrangement 121 includes a bit brake 201 arranged along the non-confined dimension and bit drive 203 arranged along the confined dimension. The bit brake 201 includes a brake actuator 205 and brake member 207. The brake actuator 205 is a linear actuator or other drive mechanism to urge brake member 207 into engagement with composite bit 119. The bit brake 201 selectively holds the composite bit 119 in position to provide control of the motion of the composite bit 119 through the compact drill assembly. The selective engagement permits rotation of the composite bit 119. That is, bit brake 201 does not hold the composite bit 119 in place during drilling. Rather, for example, bending load forces on the composite bit 119 bit urge the composite bit 119 into a groove of a rear plate of the bit brake 201 that keeps the composite bit 119 in the same shape while drilling. The brake member 207 allows rotation of the composite bit 119 when the drilling spindle 115 is rotating the composite bit 119. Bit brake 201 provides a mechanical arrangement that retains the composite bit 119 in place, but allows relative motion between the composite bit 119 and the compact drill assembly 104 to allow the compact drill assembly 104 to retract or feed the bit into the drilled hole 125.

Figure 3:
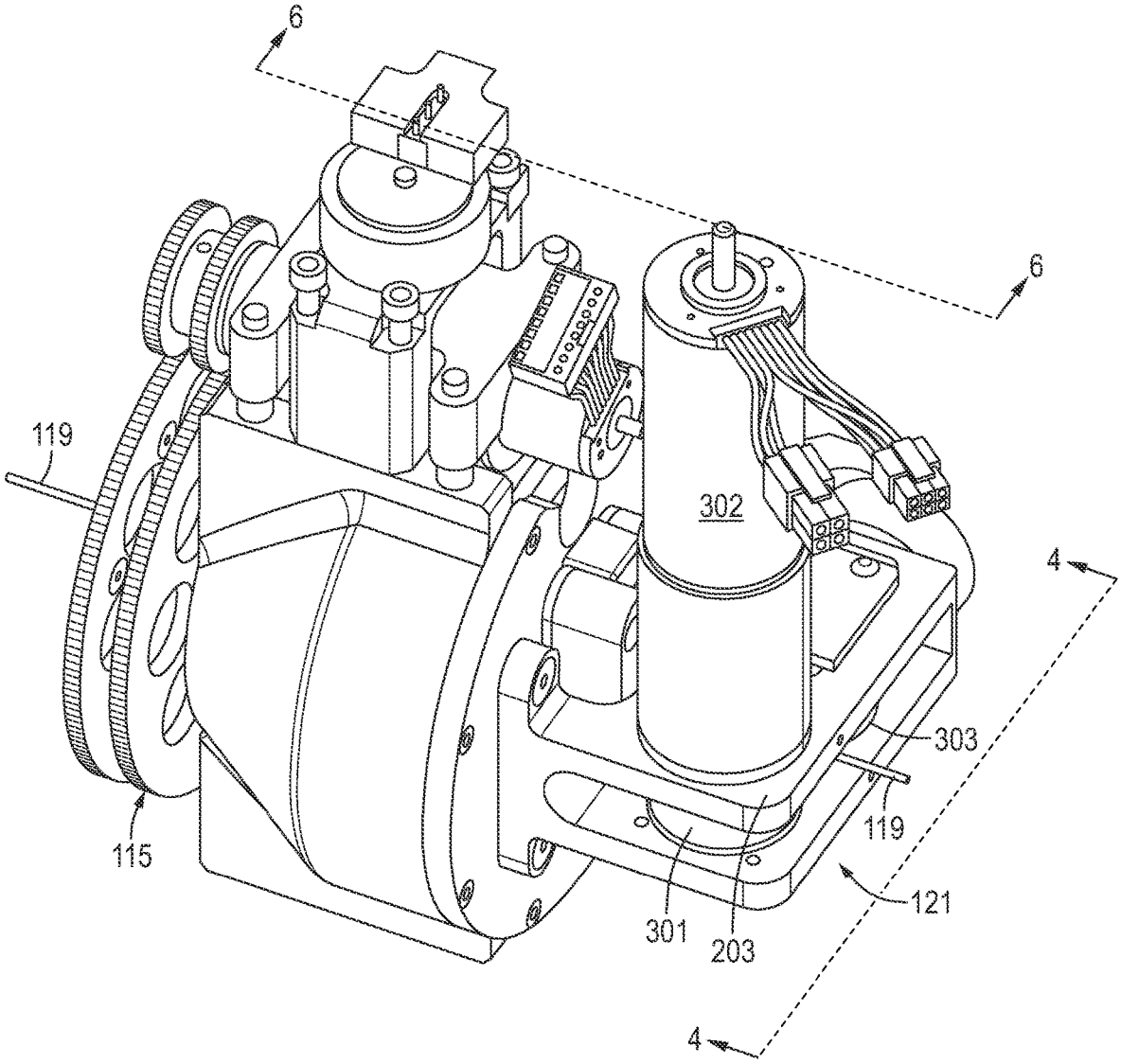
FIG. 3 shows a perspective view of a portion of the compact drill assembly with the housing removed according to an embodiment of the present disclosure.
Figure 5:
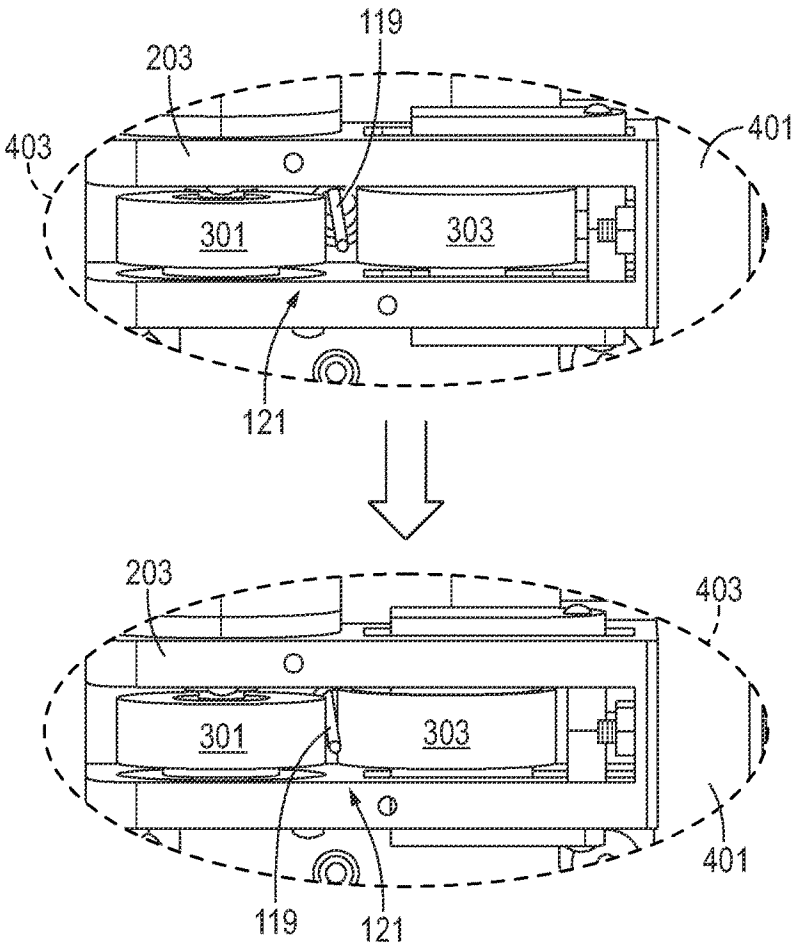
FIG. 5 shows an enlarged portion of the bit conveying arrangement of FIG. 4 moving from a released position to an engaged position.
Figure 4:
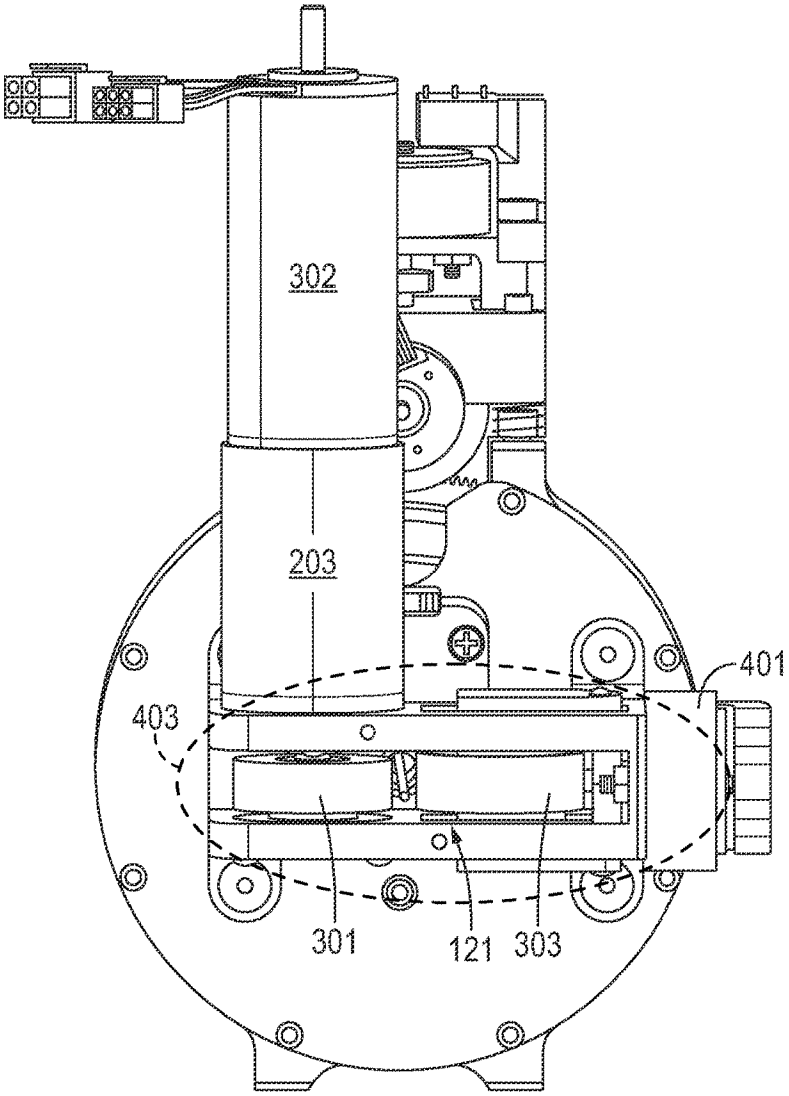
FIG. 4 shows an elevational view of the portion of the compact drill assembly of FIG. 3 shown in direction 4-4.

FIGS. 3-4 show a portion of the compact drill assembly 104, including the drilling spindle 115, separated from housing 111. As shown in FIGS. 2-4, the bit drive 203 advances or retracts composite bit 119 through the drilling spindle 115. Bit drive 203 includes a drive wheel 301 driven by bit motor 302 and idler wheel 303 that selectively engage composite bit 119 to move the composite bit 119 into or out of drilling spindle 115. Bit motor 302 is any suitable motor arranged and disposed to rotate drive wheel 301. As shown in FIG. 4, bit drive 203 further includes a drive actuator 401 to move idler wheel 303 into contact with the composite bit and drive wheel 301. The drive actuator 401 is a linear actuator or other drive mechanism to urge idler wheel 303 into a frictional engagement with composite bit 119 and drive wheel 301. The idler wheel 303 is permitted to freely rotate while the drive wheel 301 rotates against composite bit 119 and idler wheel 303 to advance or retract composite bit 119 into the drilling spindle 115. FIG. 5 shows an enlarged section 403 from FIG. 4 illustrating action of the drive actuator 401 on idler wheel 303, directing the idler wheel 303 into drive wheel 301. The top enlarged section 403 of FIG. 5 shows the idler wheel 303 in the released position, while the lower enlarged section 403 of FIG. 5 shows idler wheel 303 in the engaged position. When the idler wheel 303 is in the engaged position, the bit motor 302 may rotate the drive wheel 301 and advance or retract composite bit 119 into or out of drilling spindle 115.

As shown in FIGS. 1-2, a linear drill drive 123 is arranged and disposed to advance the rotatable drilling spindle 115 along the confined dimension 103. As shown in FIG. 1, the linear drill drive 123 advances the drilling spindle 115 along a horizontal axis into the side of the wellbore 102 to form drilled hole 125 and provides the force utilized for drilling. The linear drill drive 123 may provide the advancing motion of the drilling spindle 115 by any suitable mechanism. For example, as shown in FIG. 1, the linear drill drive 123 may be a worm drive driven by a rotary motor. However, other mechanisms may be utilized, such as linear actuators, rack and pinion arrangements, ball screw or lead screw, electromagnetic linear motor, piezoelectric linear drive, belt or cable driven system or any other mechanism that enables linear motion.

FIGS. 2 and 6-7 show cutaway views of the drilling spindle 115 including the actuated locking collet assembly 117 to engage and release composite bit within the drilling spindle 115. The actuated collet assembly 117 includes a collet 209, collar 211 and a collar nut 212. The collar 211 includes a tapered geometry that compresses the collet 209 when the collar 211 is engaged along the outer surface of the collet 209. Collar 211 includes outside threading 213 that engages internal threading 215 of collar nut 212 that, when the collar nut 212 is rotated, drives the collar 211 toward or away from the collar nut 212. In a first rotational direction, the collar 211 is urged toward the collar nut 212 and includes surfaces of collar 211 that engage and compress collet 209 into an engaged position. In a second rotational direction, the collar 211 is urged away from collar nut 212 where the engaged surfaces of the collar 211 allow a releasing of collet 209. Specifically, as shown in FIG. 2, the collet 209 engages and retains composite bit 119.

The actuated locking collet assembly 117 is engaged and disengaged via rotation of the driving gear 217 with respect to locking gear 219. Locking gear 219 is attached to collar 211 and rotates independently with respect to driving gear 217 and collar nut 212. Driving gear 217 is attached to and provides rotation of collar nut 212 with respect to collar 211. Collet motor 221 is rotationally attached to driving pinion 223 to facilitate rotation of driving pinion 223. Locking pinion 225 is fixed in place and is not permitted to rotate. When actuated, actuated locking collet assembly 117 is moved from an engaged position to a released position or from a released position to an engaged position by activation of a collet actuator 227, which moves collet motor 221, driving pinion 223, and locking pinion 225 into engagement with locking gear 219 and driving gear 217. The collet actuator 227 is a linear actuator or other drive mechanism capable of urging collet motor 221, driving pinion 223, and locking pinion 225 into engagement with locking gear 219 and driving gear 217. The collet actuator 227 may include any suitable linear drive, such as, but not limited to a worm drive driven by a rotary motor, linear actuators, rack and pinion arrangements, ball screw or lead screw, electromagnetic linear motor, piezoelectric linear drive, belt or cable driven system or any other mechanism that enables linear motion. The collet motor 221 rotates the driving pinion 223 and, accordingly, driving gear 217, to urge the collar 211, via outside threading 213 and collar nut 212, via internal threading 215, toward or away from each other.

FIG. 7 illustrates actuation of actuated locking collet assembly 117 including enlarged section 601 and enlarged section 603 from FIG. 6. As shown in FIG. 7, the collet 209 is compressed by frictional engagement with collar 211. To begin the actuation into the engaged position, the collet actuator 227 is activated to urge the driving pinion 223 and locking pinion 225 into engagement with driving gear 217 and locking gear 219, respectively (on left). Collet motor 221 rotates the driving pinion 223 so that the driving gear 217 rotates collar nut 212 and urges collar 211 via outside threading 213 and collar nut 212 via internal threading 215 toward each other, compressing the collet 209 to engage and retain composite bit 119.

Figure 8:
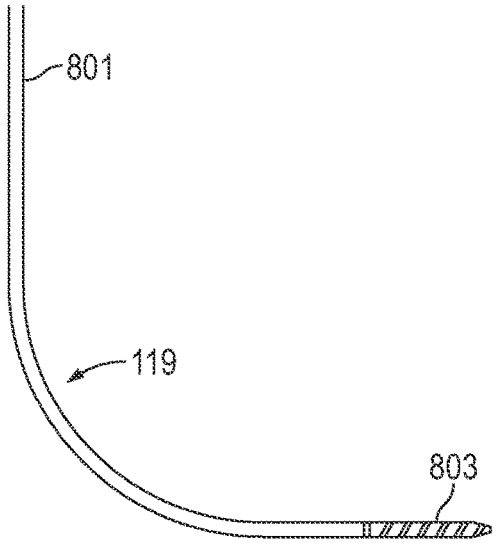
FIG. 8 shows a composite bit according to an embodiment of the present disclosure.

FIG. 8 shows a composite bit 119 according to the present disclosure. The configuration of the confined space 101 may not allow sufficient length for a conventional rigid drill bit to be positioned along the axis of the confined dimension 103 to provide drilled holes 125 of desired depth. Accordingly, composite bit 119 includes a rigid section 801 and a flexible section 803. In one embodiment, the rigid section 801 is carbon tool steel, high-speed steel, cobalt high-speed steel. Rigid section 801 may also include carbide, ceramic, or titanium. Other suitable materials for rigid section 801 may include cutting materials, such as, but not limited to, polycrystalline diamond composite inserts or diamond cutting elements. In one embodiment, the flexible section 803 is nitinol or carbon fiber. Flexible section 803 may include, but is not limited to, titanium, spring steel, polymers (e.g., Nylon). In another embodiment, the rigid section 801 and the flexible section 803 are a unitary component, such as a component having unitary material. In this embodiment, the rigid section 801 may have at least some flexibility. For example, in the embodiment where a unitary material is utilized, the composite bit 119 may be a spring steel part with a sharp cutting edge that is locally heat treated for hardness. The rigid section 801 and flexible section 803 are joined utilizing any suitable technique, including but not limited to welding, soldering, brazing, adhesion, mechanical interconnection, interference fits, geometric fits (e.g., keys, flats on shafts, or set-screws). The rigid section 801 and the flexible section 803 are joined utilizing techniques that allow sufficiently high torque capabilities for drilling, sufficient flexibility of the flexible section 803 for drilling and permit sufficient cutting ability of the rigid section 801 for drilling.

Figure 9:
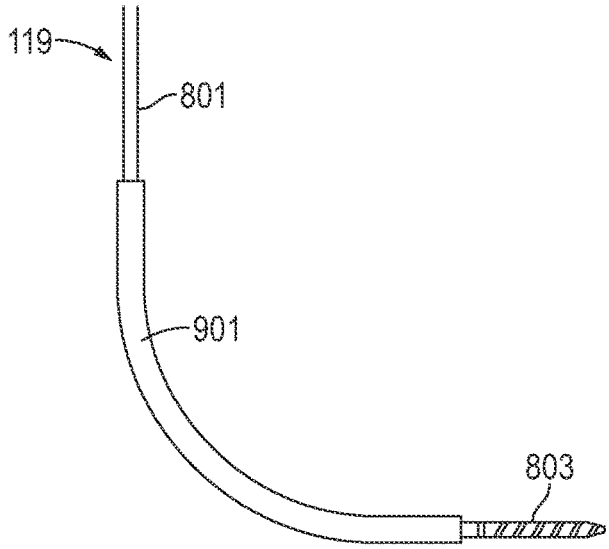
FIG. 9 shows a composite bit in a directional conduit according to an embodiment of the present disclosure.

FIG. 9 shows such an alternate embodiment for composite bit 119 drilling at a 90-degree bend. As shown in FIG. 9, the composite bit 119 is directed through a conduit 901 to facilitate controlled drilling at angles to the original direction from which the composite bit 119 is fed. The conduit 901 may be utilized within the compact drill assembly 104 or outside of the compact drill assembly 104 to permit drilling in locations that are otherwise could not be reached due to the angle at which the drilling is to take place. The composite bit 119 arrangement, as shown in FIG. 9 allows the composite bit 119 to pass entirely through it with a bend at a significant angle. For example, while not so limited the composite bit 119 may bend at 90-degrees or within 5 degrees or within 10 degrees or within 15 degrees or within 30 degrees or within 45 degrees of 90 degrees. In other embodiments, multiple conduits 901 of arbitrary lengths and angles may be used to guide the composite bit 119. In theory bits of arbitrary length could be used. Conduit 901 may allow standoff from the compact drill assembly 104 to the point of drilling. For example, in one embodiment, the compact drill assembly 104 may be aligned along the unconfined dimension 105 and the bend of the composite bit 119 along the confined dimension 103 may be downstream of the collet assembly 117. Conduit 901 may be utilized in particularly tight confined spaces 101, such as confined spaces 101 having small diameters or irregular diameters. Conduit 901 may also be used if it is not possible to bring the collet assembly 119 close enough to the entry point of the composite bit 119. For example, in one embodiment, the conduit 901 may be utilized to direct the composite bit 119 to drill a ½" diameter hole at the bottom of a confined space 101 that is a few inches deep. Conduit 901 may permit drilling in arbitrarily complex geometries.

In other embodiments, the composite bit 119 may be a rigid bit and the conveying arrangement 121 is disposed within the housing 111 to allow for feeding the rigid bit in the confined dimension.

Embodiments according to the present disclosure include drilling methods for drilling small diameter, high aspect ratio drilled holes in a confined space 101. A compact drill assembly 104 is secured within the confined space with securing features 113. Composite bit 119 is conveyed by the compact drill assembly 104 along the non-confined dimension 105 and along the confined dimension 103, at an angle to the wellbore 102. For example, while not so limited the composite bit 119 may be conveyed at an angle of 90-degrees or within 5 degrees or within 10 degrees or within 15 degrees or within 30 degrees or within 45 degrees of 90 degrees to the non-confined dimension 105. The composite bit 119 is advanced along the confined dimension 103 and is rotated with the compact drill assembly 104 to drill into a surface along an edge of the confined space 101. The compact drill assembly 104 includes a drilling spindle 115 that includes an actuated locking collet assembly 117 that can clamp and release a composite bit 119, a rotary motor to produce drilling torque and rotary motion, and a linear drill drive 123 to produce drilling force and linear motion, and a drill bit feed mechanism capable of clamping, releasing, and translating the drill bit relative to the drilling spindle along the drilling direction. The method and system minimize the unsupported drill bit length throughout the process, enabling the bit to be progressively fed from the drilling spindle as depth increases. The compact drill assembly, when used with flexible composite bits 119, drills holes of arbitrary depth and aspect ratio may be drilled orthogonal to the wellbore. The method and system achieve holes with substantially greater aspect ratios than conventional methods with very long drill bits.

Through a series of sequential steps, the compact drill assembly 104 is capable of remote and/or automated drilling. To begin the drilling process, the composite bit 119 is placed into the feeding mechanism including the bit drive 203 which consists of a geared brushed DC motor with drive wheel and an electromagnetic solenoid connected to the idler wheel 303. To advance the bit forward the feeding mechanism, as shown in FIGS. 4-5, drive actuator 401 is actuated which clamps the composite bit 119 between the drive wheel 301 and idler wheel 303. The DC motor turns the drive wheel 301 until the composite bit 119 is fed to the minimum desired unsupported drilling length. The composite bit 119 is then locked in place by the actuated locking collet assembly 117, as seen in FIGS. 2 and 6-7. To clamp the composite bit 119, collet actuator 227 is actuated, forcing the drive pinion 223 and locking pinion 225 to mesh with driving gear 217 and locking gear 219, respectively. The driving gear 217 and locking gear 219 are attached to the collar nut 212 and collar 211, respectively. With the collet actuator 227 actuated, the locking pinion 225 meshes with the locking gear 219 attached to the drilling spindle 115, thus locking the drilling spindle 115 in place. The brushless DC (BLDC) collet motor 221 rotates the driving pinion 223 that is meshed with the driving gear 217 attached to collar nut 212. Once the required torque to clamp the composite bit 119 is achieved, the collet actuator 227 disengages and the BLDC drilling motor 200 rotates the composite bit 119. The required motor torque to clamp may depend on the transmission ratio between the collet motor 221 and collet assembly 117. In one embodiment, the torque utilized to clamp at the composite bit 119 is a minimum of the drilling torque/coefficient of friction of composite bit 119 and collet assembly 117. The drilling torque/coefficient of friction, as utilized herein, is drilling torque divided by the coefficient of friction. Examples of suitable values for the transmission ratio between the collet motor 221 and collet assembly 117 include, but are not limited to, 1:1 or 5:1 or 10:1 or 20:1. To clamp the composite bit 119, in one embodiment, while not limited, collet motor 217 may be run to clamp the composite bit 119 until the motor stalls resulting in approximately 12.5 Nm of torque at the composite bit 119. The linear drill drive 123 advances the mechanism forward towards the desired area to be drilled to begin drilling. The linear drill drive 123 continues to advance the drill spindle 115 forward for the full length or near full length of the unsupported composite bit 119, while periodically reversing to clear chips as needed. Once the length of the unsupported composite bit 119 has been drilled, the linear drill drive 123 reverses, the composite bit 119 is released by the actuated locking collet assembly 117, and the composite bit 119 is fed to the minimum desired unsupported drilling length. This process is repeated until the desired hole depth is achieved.

The compact drill assembly and method according to the present disclosure form small diameter, deep holes having a length/diameter (L/D) greater than 75:1 or greater than 100:1 or greater than 125:1 or greater than 150:1. L/D, as utilized herein, is a ratio of length of the drilled hole to the diameter of the drilled hole. In one embodiment, the L/D ratio is 144:1 or greater. Specifically, in one embodiment, drilled hole 125 may be a 1/16 inch or less diameter hole with a depth of 9 inches or greater at a L/D ratio of at least 144:1.

In other embodiments, the diameter may be less than 5% of the confined dimension. In another embodiment, the diameter can be between 0.25 inch and 3 inches. In yet another embodiment, the diameter can be between 0.75 inch and 3 inches. The hole length may have an L/D of up to 1000:1. In another embodiment, the L/D can be up to 500:1. In yet other embodiments, the L/D can be up to 144:1. Hole diameters correspond to the bit diameter and hole lengths correspond to the length the bit is inserted into the material being drilled.

In other embodiments, the sequence of the process steps described above may be performed in different ways with similar outcomes achieved. For example, the actuated locking collet assembly 117 may be released and the composite bit 119 may be fed simultaneous to the linear drive 123 reversing, such that the composite bit 119 is kept in a constant axial position in the drilled hole 125. Alternatively, a clutch may be engaged while the linear drill drive 123 reverses, and the composite bit 119 may subsequently be fed back into the hole after the linear drill drive 123 has reached a fully retracted position. Additional sequences of operation are possible and may be desirable depending on specifics of the composite bit 119 utilized, the drilling medium, the properties of the cuttings, and the properties of the surrounding environment.

To enable remote and/or automatic drilling, the compact drill assembly 104 is tethered to a host PC that enables the operator to send commands to the system via keystroke. All subsystems are controlled by a master microcontroller. While not so limited, the master microcontroller may be an Arduino Mega 2560 or any other suitable microcontroller. The master microcontroller communicates with and coordinates the low-level actions of all the subsystems and associated electronics.

The compact drill assembly 104 may further include features, equipment, specialized drill bits or other mechanisms to store and/or implant sensors into drilled hole 125. For example, in the case of implanting wellbore integrity sensors behind the casing of a wellbore 102, sensors may be placed inside the drilled holes 125. In order to place the sensors, the compact drill assembly 104 is lowered to a desired depth of the wellbore along the non-confined dimension 105 by line 107 (see for example FIG. 1). The tethered or wirelessly controlled compact drill assembly 104 braces itself in place using securing features 113 and commence the drilling sequence as described above. Once the drilled hole 125 is formed with a desired depth, either the compact drill assembly 104 implants the sensor in the drilled hole 125 or a separate mechanism is lowered into position to implant the sensor. While not so limited, the compact drill assembly 104 may include a tool changing mechanism, such as tool changing mechanisms in known CNC machine tools or robotic systems to implant sensors into drilled hole 125. A sensor implantation tool would be an alternate tool to change from the composite bit 119. In this embodiment, during the changing of tools to the tool to implant the sensors, securing features 113 are kept engaged, so the tool changer would automatically align the sensor emplacement with the drilled hole 125. In another embodiment, sensors could be integrated into the drilling process. In this embodiment, a sensor mounted within the compact drill assembly 104 may be utilized to measure released pressure or gas/liquid flow as the drilled hole 125 is created. Such a measured release may indicate drilling into a defect that has accumulated pressure.

In other applications, the systems and methods may be used to place sensors at restricted points in structures such as, but not limited to buildings, dams, bridges, piers, mines and mineshafts, caves and caverns, utility pipes and other infrastructure, and any access-restricted environments. In particular, the systems and methods may be used to place sensors to monitor underground or underwater portions of buildings, dams, bridges, piers, or other infrastructure.

Figure 10:
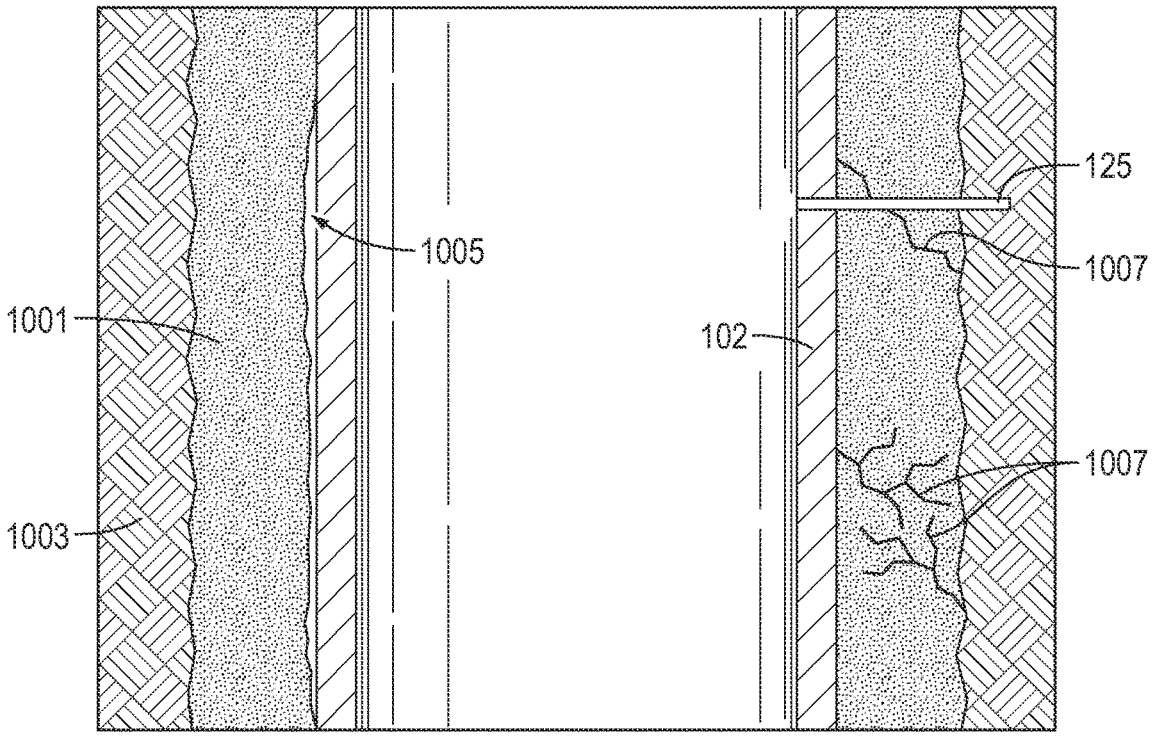
FIG. 10 shows a sketch of a wellbore surrounded by cement and a geological formation having a drilled hole for receiving a sensor.

In an embodiment, the systems and methods according to the present disclosure permit direct measurements of the casing of the wellbore 102 (see for example 1 and 10). As shown in FIG. 10, wellbore 102 is surrounded by cement 1001 and formation 1003. Cement 1001 surrounds the wellbore 102 between formation 1003 and the casing of wellbore 102. Formation 1003 is, for example, a rock formation through which the wellbore was drilled. The cement 1001 and formation 1003 may include undesirable features such as a micro annulus 1005 or cement fractures 1007. Drilled hole 125, formed by compact drill assembly 104, includes a space into which one or more sensors may be placed. By placing sensors, either temporary or permanent, in these areas, the presence of micro annulus 1005 or cement fracture 1007 may be sensed. The method and system are not so limited and may include other sensors that may sense other features of the wellbore 102 and the surrounding structure. Positioning of one or more of these sensors may permit initial measurements to be taken from wellbore 102 to provide gross indications and locations of potential failures. Subsequently, small holes may be drilled, and sensors emplaced to further characterize and localize any damage so that it may be repaired or monitored for further remediation. These sensor access holes must be deep enough to reach the desired depths (typically up to 8-12 inches, and potentially up to 3-4 feet or more), but their diameters must be minimized (typically well below 0.25 inches, and perhaps as small as ~0.01 inches) to avoid lasting damage to the wellbore 102. These small, deep drilled holes 125 are drilled from inside a wellbore 102 that may be as small as 6 inches in diameter, far removed (e.g., miles or kilometers down a wellbore) from human operators. In addition, multiple drilled holes 125 may be formed to provide a sensor array that provide additional data over larger areas within the wellbore 102. The arrays and sensor arrangements may further be used to map out locations of where defects are present.

In various embodiments, the sensors may be, but are not limited to stress/stain gauges, acoustic sensors, humidity sensors, pH sensors, temperature sensors, vibration sensors, pressure sensors, flow sensors, chemical sensors, optical sensors or imagers, ultrasound sensors, conductivity or other electrical sensors, radiation sensors, or any combination of the sensors.

In other embodiments, sensor technology may include sensing with the compact drill assembly while drilling, inserting temporarily after drilling, and inserting and leaving as a permanent sensor. In addition, compact drill assembly 104 may condition the drilled sensing holes for permanent emplacement, and/or repair or plug drilled holes 125 once temporary sensors have been removed. In another embodiment, a tool changer may be utilized by the compact drill assembly 104 to transition between drilling, sensor placement, and hole remediation, all referenced to the hole location.

In addition to sensor placement, the systems and methods according to the present disclosure may be utilized for fluid and sample extraction, formation of mechanical features (e.g., location identifiers or anchors), geologic access (e.g., as in fracking) or other processes that benefit from high aspect ratio, small diameter holes formed at remote locations in a confined space.

The methods according to the present disclosure include performing engineering analysis and testing utilizing the compact drill assembly 104 to support physical limitations of conventional feed systems is disclosed that includes predicting buckling load limits associated with specific hole and drill bit geometries and physical properties, predicting chip loading in drill bit flutes based on distance drilled, drilling properties, and material properties, predicting and monitoring drilling dysfunction based on these predictions and on measurements of the drilling system; and autonomously changing rotary speed, and axial translation speed, force and location to stop the onset of drilling dysfunction.

Vibrations, especially those near harmonic resonance, are a primary cause of drill string failures, resulting in lost time and abandonment of drill holes. Drill bit vibrations are relevant in the lateral, angular, and longitudinal axis of drill bits, and in bits with large aspect ratios lateral and angular vibrational modes appear to be primary contributors to stresses that result in drill string failures. In conventional boring or drilling, the speed of the cutting surface is dictated by the material being drilled. Consequently, the rotational speed is inversely proportional to the bit diameter.

In the above case, the lateral bit deflection can be treated like a cantilever beam, while the torsional deflection can be modeled as a fixed-free shaft. The lateral deflection of the drill bit can be determined from Euler beam theory which can appropriately describe bit wobble $$y = \frac{\partial U}{\partial F_y} = \left[\frac{L^2}{3EI}\right]F_y \tag{1}$$

while the angular deflection of the bit is $$\theta = \frac{\partial U}{\partial T} = \left[\frac{2(1+r)L}{EJ}\right]T \tag{2}$$

Factoring out and inverting the bracketed terms in (1) yields the lateral bit stiffness.

$$k_y = \frac{3EI}{L^2} \tag{3}$$

With the same done to (2) that results in the torsional stiffness as $$k_\theta = \frac{EJ}{2(1+y)L} = \frac{GJ}{L} \tag{4}$$

The lateral and torsional stiffnesses of the bit in Equations (3) and (4) can be devised by n number of segments and lumped masses which can then be used for dynamic analysis of the bit. An n-segmented drill bit results in the following equations of motions for the lateral motion $$[M]_{nxn}[\ddot{y}]_{nx1}+[K]_{nxm}[y]_{nx1}=\{F(t)\}_{nx1} \tag{5}$$

and for the angular rotation $$[J]_{nxn}\{\ddot{\theta}\}_{nx1}+[\kappa]_{nx1}=\{F(t)\}_{nx1} \tag{6}$$

where the vibrational modes can be analyzed by solving for the eigenvalues of the characteristic equation of (5) and (6). By analyzing the natural frequencies, it can be determined if vibrational excitation near natural modes are a relevant issue. All of the natural frequencies move into the operating regime of drilling speeds (hundreds to several thousand revolutions per minute) that typically have lower order modes of natural frequency. In addition to this, high aspect ratios can have large deflections from relatively small loads (from misalignment and/or machining reaction forces) that can be problematic.

Figure 11:
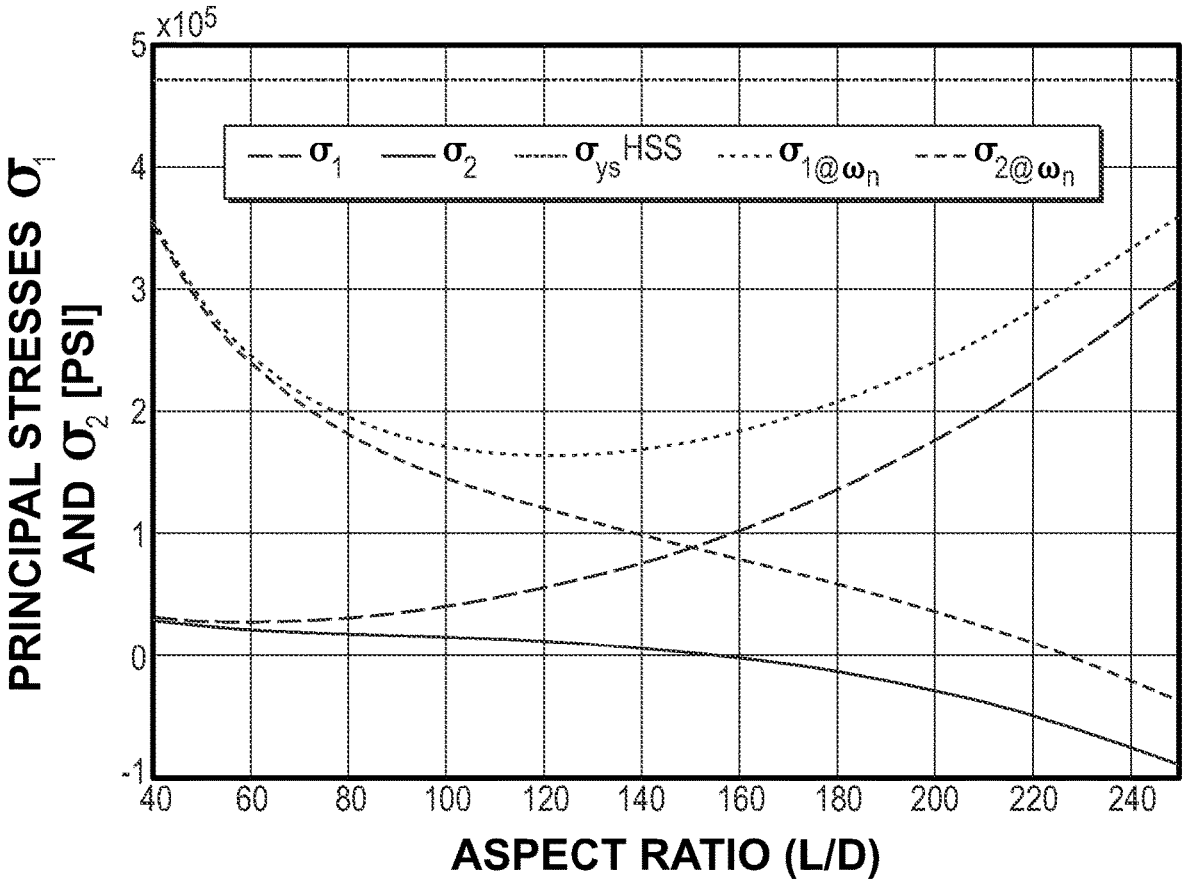
FIG. 11 includes a graph showing principal stresses resulting from the application of free end forces and torques with respect to aspect ratio.

Considering lateral deflections and empirical drill force and torque data, the principal stress can be estimated for a variety of different aspect ratios for a constant bit length of 10 inches as depicted in FIG. 11, with consideration of a 13 times increase in bending stresses at harmonic resonance. FIG. 11 shows that increasing aspect ratios for bits see higher principal stresses that are approximately 60% of the yield strength of high-speed steel (HSS). This basic analysis shows that excitations near harmonic resonances may induce failure of the bit material, where at resonance the stresses can increase by over an order of magnitude and can even be further exacerbated by additional loading due to chip clearing.

Figure 12:
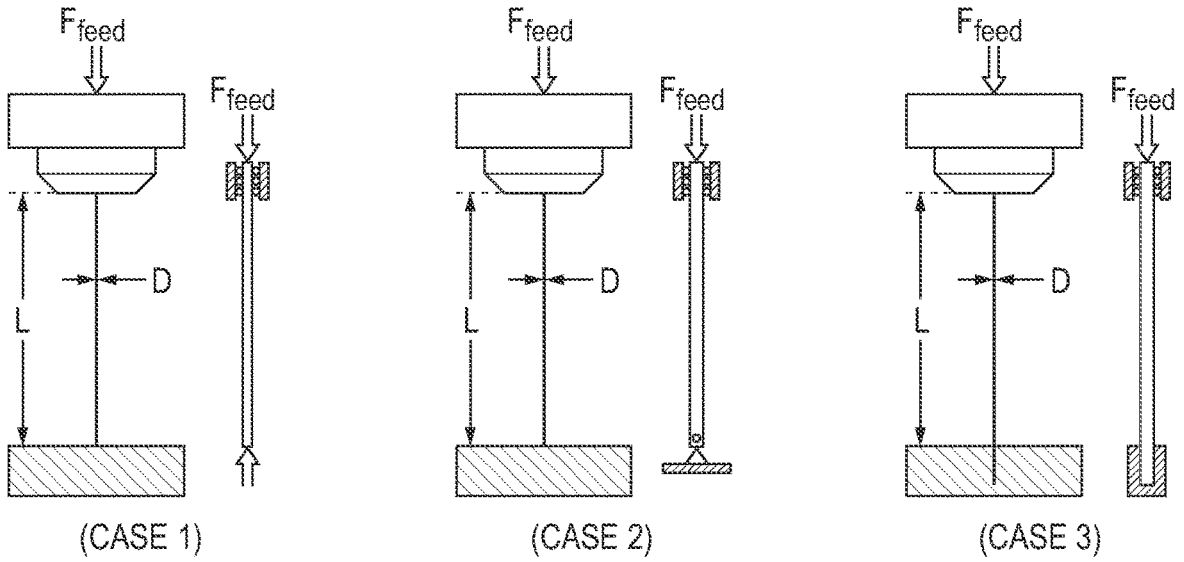
FIG. 12 shows a schematic view of the drill-bit assembly with different cases of plausible models of end conditions as they affect buckling.

FIG. 12 is a schematic of the drill-bit assembly with different cases of plausible models of end conditions as they affect buckling. Case 1 illustrates the drill-bit assembly prior to and when initiating contact where the constraints are fixed-free, case 2 illustrates initial drilling where the constraints are fixed-pinned, and case 3 illustrates when the bit is inside the drill bore which has a fixed-fixed column constraint.

The first scenario (case 1), where the tip is first beginning/prior to contacting the tool piece, the bit has a free end, resulting in the effective length of the column as $$L_1'=2L \tag{7}$$

In case 2, the bit end in contact with the tool piece (e.g., in a dimple created by a spot drill) is considered a pin joint, giving a fixed-pin column constraint that has the following effective length in Equation (8).

$$L_2'=0.7L \tag{8}$$

The fixed-fixed condition for case 3 is defined by Equation (9).

$$L_3'=0.5L \tag{9}$$

Figure 13:
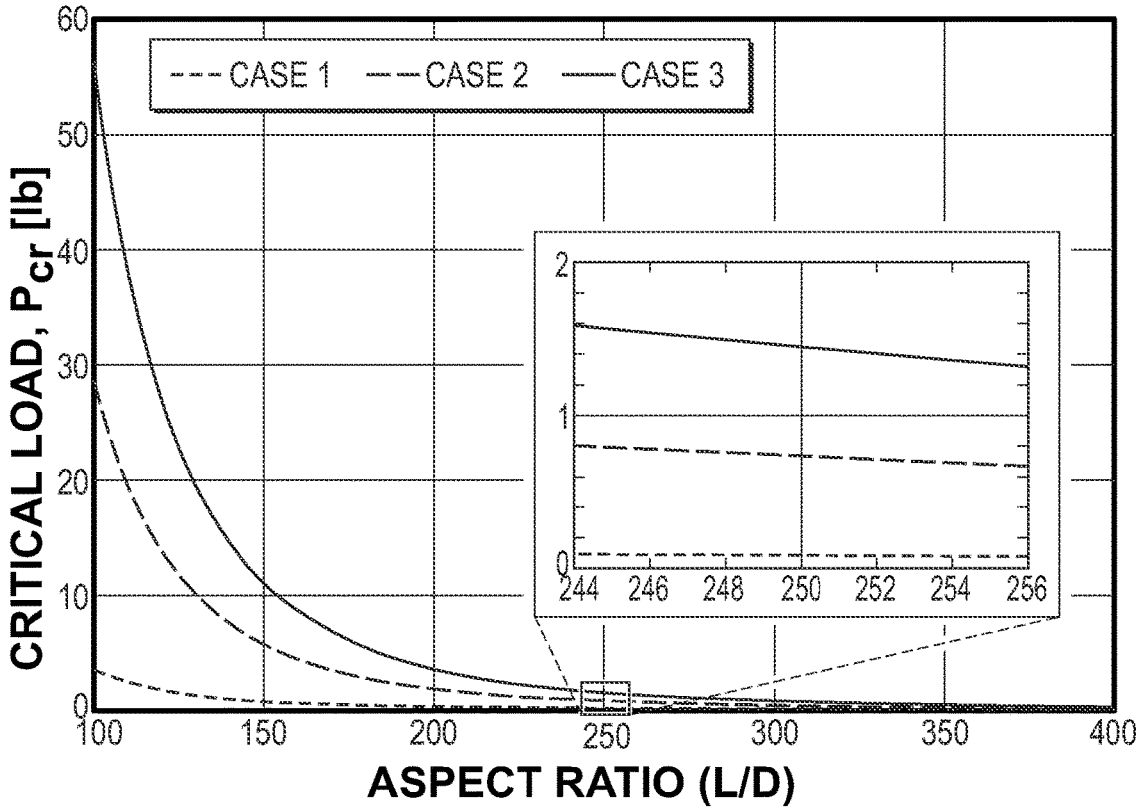
FIG. 13 includes a graph showing critical buckling load as a function of drill bit aspect ratio for L=10 inches and D=0.025-inch–0.1 inch.

The effective length allows the critical loading of the column to be determined by $$P_{cr} = \frac{\pi^2 EI}{(L_i')^2} \tag{10}$$

where E is the modulus of elasticity of the bit material, and I is the second area moment of inertia. The technical challenge can be better understood by analyzing the critical load for different aspect ratios. For this, the length of the bit is assumed to be 10 inches, while we sweep the diameter of the bit from 0.025-0.125 inches. The critical loading of the bit for this parameter sweep and effective length conditions are depicted in FIG. 13. FIG. 13 show that aspect ratios greater than 250 with a bit length of 10 inches require less than 1.5 lb force to buckle with the highest aspect ratio case requiring only a few ounces of axial force to cause buckling.

The total torque and force required for drilling is the combination of chip generation torque and force and chip evacuation torque and force. Chip generation loads are independent of depth and can be estimated from tool geometry, formation material, and operating conditions. The chip evacuation loads are a result of friction and back pressure generated between the bit and borehole wall due to chips packing the flute volume. Modeled effects of flute geometry on drilling torque and force show, through modeling and experimental data, that there exists a non-linear increase in both torque and force as the flutes load up with increasing depth. They established a critical depth at which the torque values exceed a threshold based on estimated mechanical failure of the drill bit. This critical depth is used to determine the peck depth of a peck drilling operation. For deep holes, it is noteworthy that even if flutes are extended to the full depth of the hole, to potentially allow for chip clearing while drilling, the drilling torque and force will increase substantially as the flutes fill up, ultimately causing dysfunction or bit failure.

The compact drill assembly 104 according to the present disclosure has the ability to drill small diameter (0.01 inches-0.25 inches), arbitrarily deep holes. For the compact drill assembly 104 to overcome the dysfunctions and limitations associated with a standard unsupported drilling operation, the compact drill assembly 104 includes the ability to incrementally drill with a minimal unsupported drill length.

EXAMPLE

A test specimen fixture was instrumented with a load cell and torque sensor to measure and record the thrust force and drilling torque throughout the drilling operation. A set of drilling experiments was conducted with this instrumented system. For a second set of experiments, the ability of the system to drill deep holes was evaluated with a long (~9 inches) acetal homopolymer test sample. To accommodate the length of the long test specimen while maintaining a rigid drill setup, the instrumented mounting fixture was removed, and the long test specimen was attached to the bench top linear drive stage with a non-instrumented fixture. For both experimental setups the mechanism performed an incremental drilling sequence, enabling the system to drill while maintaining a minimal unsupported drill length. In addition to the incremental drilling sequence, the mechanism also attempted to perform a "standard" drilling operation with the starting unsupported drill length matching the final desired hole depth. This enabled a performance comparison to standard drilling methods.

To quantify the performance of the system, force and torque time histories from the instrumented experiments are compared and analyzed considering the dysfunctions explored above. The instrumented experiments consist of sequential drill and dwell operations in which the mechanism actively drills forward, stops forward movement, dwells, and continues forward motion. To evaluate the performance of the system, the maximum achievable hole depths from the non-instrumented deep hole experiments are measured and compared.

Figure 14:
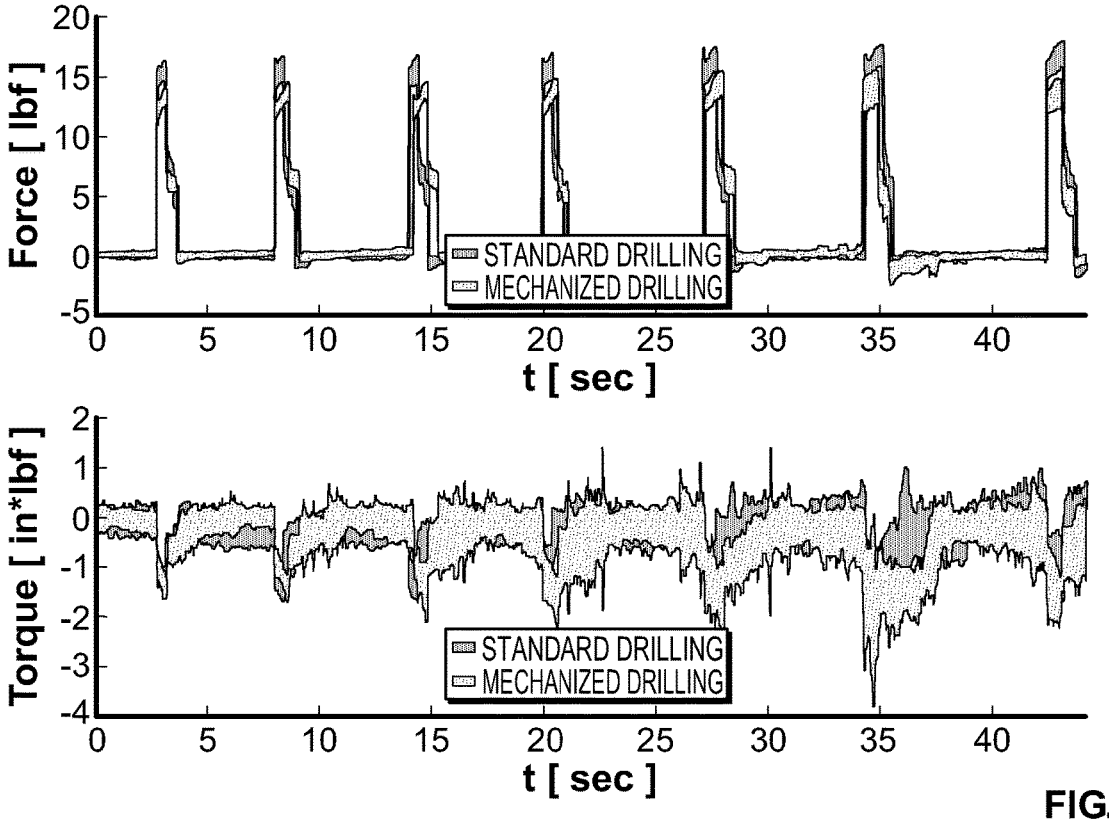
FIG. 14 includes a graph showing force and time histories for drilling with 5/32-inch drill bit according to an embodiment of the disclosure.
Figure 15:
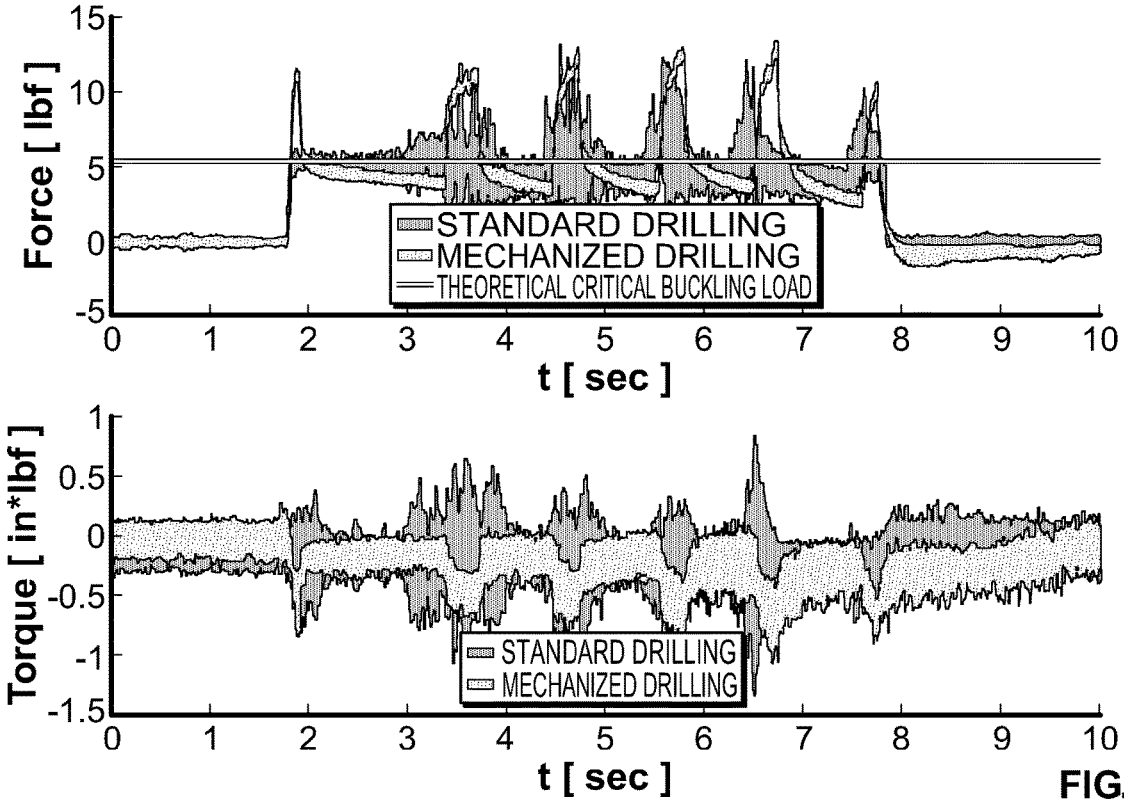
FIG. 15 includes a graph showing force and torque time histories for drilling with 1/16-inch drill bit according to an embodiment of the disclosure.

FIG. 14 presents the force and torque measurements for both "standard" (with the full drill bit length unsupported) and "mechanized" (using the advancement system) drilling of an acetal homopolymer test sample with a 5/32-inch drill bit. Both standard and mechanized drilling operations successfully drilled the entire depth of 9 inches during the non-instrumented deep hole tests. Considering the testing parameters, none of the dysfunctions discussed in earlier sections would be expected during standard or mechanized drilling of an acetal homopolymer test sample with a 5/32-inch drill bit. As seen in the collected force data, the drilling force throughout standard and mechanized drilling are far below the theoretical critical buckling load presented in FIG. 13. FIG. 15 presents the force and torque measurements for standard and mechanized drilling of an acetal homopolymer test sample with a 1/16-inch drill bit. The standard drilling operation was unsuccessful at drilling at an unsupported length of 9 inches and resulted in buckling of the bit. As seen in FIG. 15, during the initial drill the measured force for the standard drilling operation increases until the drill bit buckles. From FIG. 15, it can be seen that the experimental buckling load (~5 lbs.) roughly matches the theoretical critical buckling load for the fixed-pin case presented in FIG. 13. The bit continued to buckle after continual pullback and dwell operations, indicated by the relatively constant average force on the bit as seen in FIG. 15. In contrast, the 1/16-inch diameter hole drilled with the custom mechanism was able to successfully transfer the required loads through the bit to facilitate drilling regardless of depth. These drilling conditions enabled a full 9-inch hole to be completed—achieving a ratio of 144:1.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A compact drill assembly for drilling high aspect ratio, small diameter holes in a confined space having a confined dimension and a non-confined dimension, the assembly comprising:

a housing having a geometry that allows insertion into the confined space;

a rotatable drilling spindle that includes an actuated locking collet assembly arranged and disposed to selectively secure and release a bendable bit;

a bit conveying arrangement comprising a bit brake, the bit conveying arrangement configured to convey the bendable bit along the non-confined dimension and along the confined dimension through the actuated locking collet assembly; and a drill drive arranged and disposed to advance the bendable bit along the confined dimension;

wherein the bendable bit undergoes a bend when being conveyed via the bit conveying arrangement;

wherein the bendable bit undergoes a bend between the bit brake and the actuated locking collet assembly;

wherein the confined dimension is a first distance in a first direction between first structures defining the confined space; and wherein the non-confined dimension is in a second distance in a second direction wherein the non-confined space is not bordered by the first structures in the direction from which the rotatable drilling spindle enterers from the non-confined dimension.

2. The compact drill assembly of claim 1, wherein the ratio of the confined dimension to non-confined dimension is greater than 5:1.

3. The compact drill assembly of claim 1, wherein the bendable bit is capable of being extended from the housing up to a length L such that the ratio of bit diameter to length L is up to 1000:1.

4. The compact drill assembly of claim 1, further comprising a securing feature arranged and disposed to be actuatable to secure the compact drill assembly in the confined space.

5. The compact drill assembly of claim 1, wherein the actuated locking collet assembly includes a collar, collar nut, and a collet, the collar including a tapered surface engaging an outer surface of the collet and outside threading mating an inside threading of the collar nut such that, when rotated, the collar is urged toward or away from the collar nut to compress the collet onto the bendable bit.

6. The compact drill assembly of claim 1, wherein the bit brake is configured to maintain a bent shape of the bendable bit.

7. The compact drill assembly of claim 1, wherein the actuated locking collet assembly includes a locking gear attached to a collar and a driving gear attached to the collar nut, the locking gear and driving gear being independently rotatable.

8. The compact drill assembly of claim 5, further comprising:

the collet actuator arranged and disposed to selectively engage a driving pinion to the driving gear and a locking pinion to the locking gear; and a collet motor arranged and disposed to rotate the driving pinion and the driving gear when the driving pinion and driving gear are engaged.

9. The compact drill assembly of claim 1, wherein the drill drive is a linear stage configured to advance and retract the rotatable drilling spindle along the confined dimension.

10. The compact drill assembly of claim 1, includes a drilling motor to rotate the rotatable drilling spindle.

11. The compact drill assembly of claim 1, wherein the bit conveying arrangement comprises:

a drive wheel driven by a bit drive;

an idler wheel that is permitted to freely rotate; and a drive actuator arranged and disposed to direct idler wheel and drive wheel into contact, frictionally engaging the bendable bit.

12. The compact drill assembly of claim 1, wherein the bendable bit includes a rigid section coupled to a flexible section.

13. A drilling system, the system comprising:

the confined space;

the compact drill assembly according to claim 1 disposed within the confined space;

the bendable bit; and a control rig and a line to attach the control rig to the compact drill assembly.

14. The drilling system of claim 13, wherein the bendable bit comprises a rigid section and flexible section mounted within the compact drill assembly.

15. The drilling system of claim 13, wherein the line provides one or both of power and signal to the compact drill assembly.

16. The drilling system of claim 13, wherein the compact drill assembly is battery powered.

17. The drilling system of claim 13, wherein the compact drill assembly is wirelessly controlled.

* * * * *